US009764926B2

(12) United States Patent
Saarelainen et al.

(10) Patent No.: US 9,764,926 B2
(45) Date of Patent: Sep. 19, 2017

(54) BRAKE ASSEMBLY FOR AN ELEVATOR

(71) Applicant: KONE Corporation, Helsinki (FI)

(72) Inventors: Antti Saarelainen, Espoo (FI); Seppo Valliovuo, Hyvinkää (FI); Perttu Luukkonen, Hyvinkää (FI)

(73) Assignee: KONE CORPORATION, Helsinki (FI)

( * ) Notice: Subject to any disclaimer, the term of this patent is extended or adjusted under 35 U.S.C. 154(b) by 341 days.

(21) Appl. No.: 14/531,052

(22) Filed: Nov. 3, 2014

(65) Prior Publication Data

US 2015/0122590 A1 May 7, 2015

(30) Foreign Application Priority Data

Nov. 4, 2013 (EP) ..... 13191398

(51) Int. Cl.
*B66B 5/16* (2006.01)
*B66B 5/02* (2006.01)

(52) U.S. Cl.
CPC ..... *B66B 5/027* (2013.01)

(58) Field of Classification Search
CPC ..... B66B 5/027; B66B 5/028
USPC ..... 187/254
See application file for complete search history.

(56) References Cited

U.S. PATENT DOCUMENTS 2,037,034 A * 4/1936 Loughridge ..... B66D 5/00 187/288
4,650,036 A * 3/1987 Matsuda ..... B66B 9/00 182/142
4,923,055 A * 5/1990 Holland ..... B66B 5/04 187/287
5,425,435 A * 6/1995 Gregory ..... B66D 5/14 188/264 A
5,890,565 A * 4/1999 Wang ..... B66D 5/24 187/263
6,021,872 A * 2/2000 Sevilleja ..... B66B 5/027 187/266
6,179,090 B1 * 1/2001 Casas ..... B66B 5/027 187/377
6,273,216 B1 * 8/2001 Kocher ..... B66B 5/027 187/254
6,374,953 B1 * 4/2002 Casas ..... B66D 5/08 187/314
7,392,885 B2 * 7/2008 Wang ..... B66B 5/027 187/263
2005/0103576 A1 * 5/2005 Engstrom ..... B66B 5/027 187/287

FOREIGN PATENT DOCUMENTS

JP 2001-294386 A 10/2001
JP 2013-91572 A 5/2013

* cited by examiner

*Primary Examiner* — Michael Riegelman
(74) *Attorney, Agent, or Firm* — Birch, Stewart, Kolasch & Birch, LLP

(57) ABSTRACT

A brake assembly for an elevator includes a brake, a brake operating device and a first brake wire connected to the brake operating device and to the brake, the brake operating device being configured to release the brake by moving the brake operating device and the first brake wire to a first direction. A second brake wire is connected to the brake operating device and to the brake, and the brake operating device is configured to engage the brake by moving the brake operating device and the second brake wire to a second direction.

15 Claims, 3 Drawing Sheets

BRAKE ASSEMBLY FOR AN ELEVATOR

FIELD OF THE INVENTION

The invention relates to elevators, elevator safety arrangements and more particularly to an elevator brake assembly.

BACKGROUND OF THE INVENTION

Elevator brakes are an extremely important safety feature. Elevators have different brakes designed for different purposes. The machinery brake is used to hold the elevator car in place during the elevator idle time. The machinery brake may also be used as an emergency brake in certain situations. For example, if a safety contact opens in the elevator safety chain, or during a power failure, the machinery brake is engaged and it can be operated manually by a brake lever, wherein the elevator car may be lowered to a desired position close to a door at a floor level. The machinery brake may also be used for stopping the elevator car for longer periods, for example during maintenance.

Current designs apply a manual lever that is connected to the brake by a single wire. The brake is engaged by releasing the lever, wherein the springs arranged to the brake assembly push the brake pads. The brake is released by pulling the brake lever, wherein the springs are tensioned for example to pull the brake pads off the braking surface.

Problems of the current design include high friction of the brake release mechanism that may relate to insufficient maintenance, faulty material, installation errors or a long brake wire. If the brakes are released manually, similar safety risk relate to engaging the brake.

The purpose of the invention is to solve or at least alleviate the aforementioned problems.

SUMMARY

The invention discloses a brake assembly for an elevator, comprising a brake, a brake operating device and a first brake wire connected to the brake operating device and to the brake, the brake operating device being configured to release the brake by moving the brake operating device and the first brake wire to a first direction. According to the invention the system comprises a second brake wire connected to the brake operating device and to the brake, the brake operating device being configured to engage the brake by moving the brake operating device and the second brake wire to a second direction.

In one exemplary embodiment the brake is configured to engage the brake in response to the second brake wire moving to the second direction. In one exemplary embodiment the brake comprises a returning spring to engage the brake. The second brake wire may engage the brake by moving to the second direction. Alternatively the brake may be engaged by the spring wherein the second brake wire helps to engage the brake or secures the braking action.

In one exemplary embodiment the first brake wire is mechanically connected to the second brake wire on the brake, for example by a rigid member. In one exemplary embodiment the first brake wire and the second brake wire are joined together as a single continuous wire at the brake. The first brake wire is configured to move to the second direction simultaneously when the second brake wire moves to the second direction.

In one exemplary embodiment the first brake wire and the second brake wire are arranged inside a cable at least between the brake and the brake operating device. In one exemplary embodiment the brake operating device is a lever, for example a brake lever. In one embodiment the brake operating device is an actuator that operates either electrically or electromagnetically.

In one exemplary embodiment the brake is a machinery brake comprising at least two separate brakes. The movement of the first brake wire and the second brake wire is configured to affect the at least two brakes.

The embodiments of the invention described herein may be used in any combination with each other. Several or at least two of the embodiments may be combined together to form a further embodiment of the invention. It is to be understood that any of the above embodiments or modifications can be applied singly or in combination to the respective aspects to which they refer, unless they are explicitly stated as excluding alternatives.

The benefits of the invention are related to improved elevator safety. The double action brake assembly ensures that the brakes are engaged faster and more reliably when the brake operating device such as the manual release lever is returned to the original position.

BRIEF DESCRIPTION OF THE DRAWINGS

The accompanying drawings, which are included to provide a further understanding of the invention and constitute a part of this specification, illustrate embodiments of the invention and together with the description help to explain the principles of the invention. In the drawings.

DETAILED DESCRIPTION OF THE INVENTION

Reference will now be made in detail to the embodiments of the present invention, examples of which are illustrated in the accompanying drawings.

Figure 1:
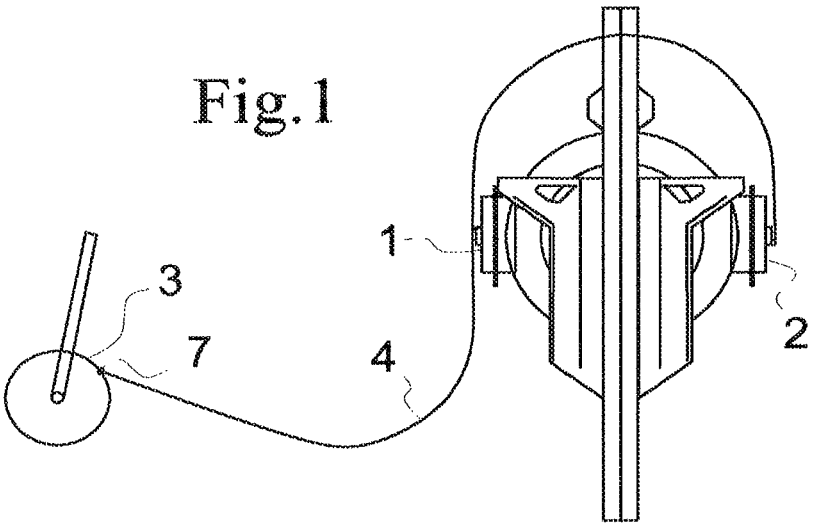
Prior Art Fig. 1
FIG. 1 is an exemplary illustration of a brake assembly according to prior art.

FIG. 1 illustrates on example of a brake assembly according to prior art. The brakes are in this example duplicated 1, 2 according to elevator safety requirements. The brake 1, 2 is a machinery brake. The elevator car is kept in its position in the elevator hoistway with a machinery brake when the car is stopped at a floor level. Brakes 1,2 are in this example configured to be used as an emergency brake that is activated during an electricity shortage or to be used during the elevator maintenance. Examples of brakes 1, 2 are shoe brakes, drum brakes or disk brakes that are configured to slow or stop the elevator movement.

A first brake wire 4 connects the brake 1, 2 to a brake operating device 3. One example of the brake operating device 3 is a brake lever, which may be pulled manually to release the brake 1, 2. The first brake wire 4 is connected to the brake lever assembly 3 on a position 7, where the lever movement is transferred to a wire movement.

The hoisting machine with the machinery brakes may be disposed in the elevator shaft, and the brake lever may be disposed in the elevator floor, outside of the elevator shaft.

Brakes 1, 2 comprise springs that push the brake pads to brake contacts such as brake drum or disc, if the force effected to the brake pads by an electrical magnet or brake lever 3 is released. The spring action should be well maintained to ensure perfect braking operation.

Figure 2:
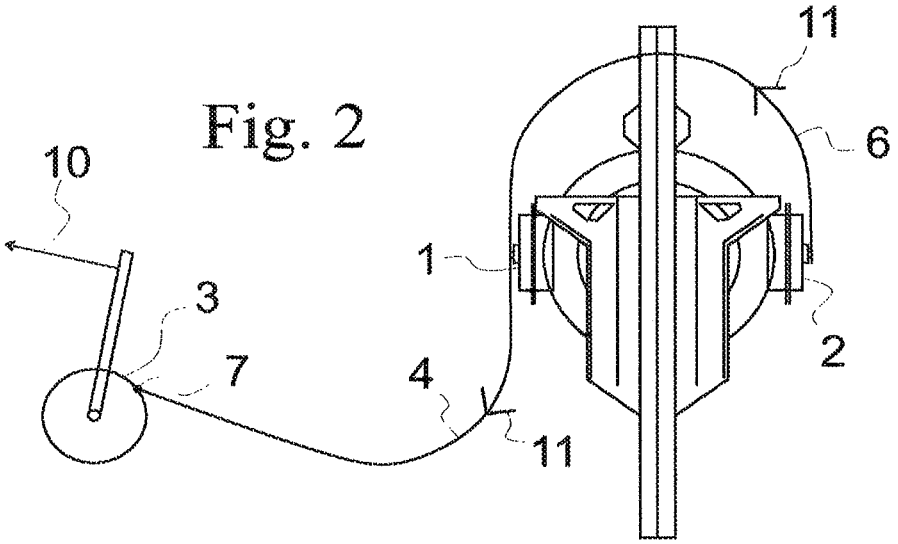
Prior Art Fig. 2
FIG. 2 is an exemplary illustration of a brake assembly according to prior art with force applied to the brake operating device releasing the brake.
Figure 3:
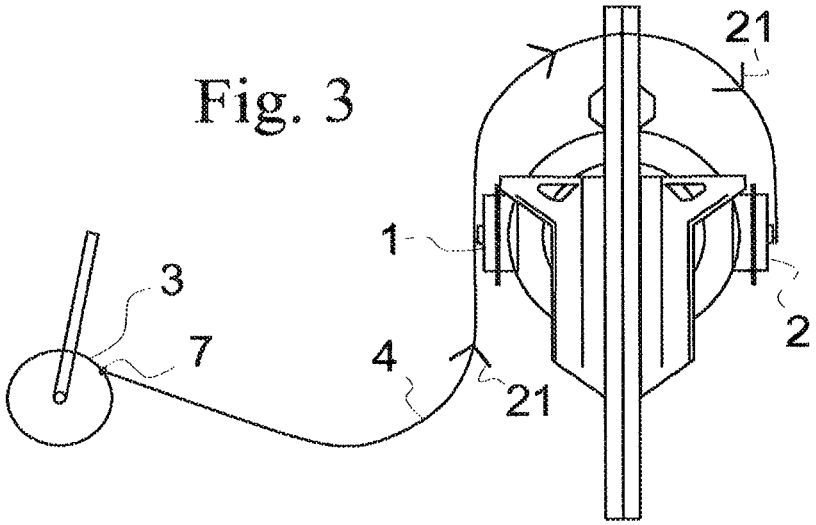
Prior Art Fig. 3
FIG. 3 is an exemplary illustration of a brake assembly according to prior art with force applied to the brake operating device engaging the brake.

FIG. 2 illustrates an example of the force 10 applied to the brake operating device 3, the manual lever in this example, to release the brake 1, 2. The force 10 to a first direction affects the manual brake lever 3 to pull the first brake wire 4 to a first direction 11. This movement affects both brakes 1, 2 as the first brake wire continues from the first brake 1 to the second brake 2. FIG. 3 illustrates the same example, when the manual brake lever 3 is used to engage the brake 1, 2. The manual brake lever 3 is released and the springs configured in the brakes 1, 2 cause the first brake wire 4 to move to a second direction 21.

Figure 4:
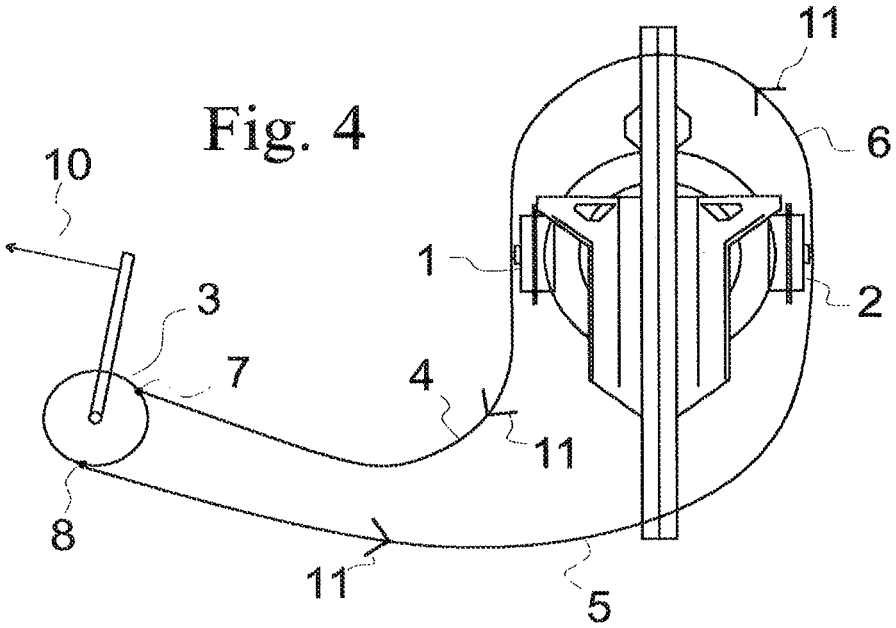
FIG. 4 is an exemplary illustration of a brake assembly according to the present invention with force applied to the brake operating device releasing the brake.

FIG. 4 illustrates one example of the present invention. A second brake wire 5 is added to the elevator brake assembly of the previous examples, connected to the brakes 1, 2 and to the brake operating device 3 on a position 8. The connection 8 to the brake operation device 3 such as manual brake lever is arranged to move the second brake wire 5 in an opposite direction to the first brake wire 4 in relation to the brake operating device 3. The first brake wire 4 and the second brake wire 5 are mechanically connected together or at least the action of the first brake wire 4 and the second brake wire 5 is continuous from one to another. In one example the first brake wire and the second brake wire 5 are joined together by a portion of the brake wire 6 between the first brake 1 and the second brake 2. The first brake wire 4 and the second brake wire 5 form a double action brake assembly. The pulling movement of the first brake wire 4 is counteracted by the pushing movement of the second brake wire 5—this movement is defined as the first direction in this description. Similarly the pushing movement of the first brake wire 4 is counteracted by the pulling movement of the second brake wire 5—this is defined as the second direction. In this example the manual brake lever 3 is moved to the first direction 10, causing the first brake wire 4 and the second brake wire 5 to move to the first direction 11. This movement releases the brake 1, 2.

Figure 5:
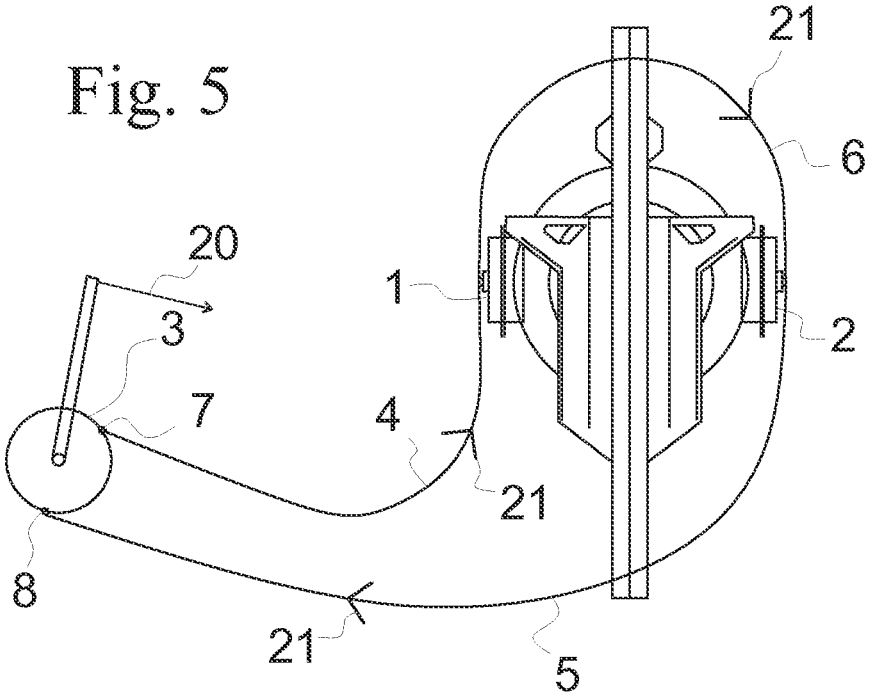
FIG. 5 is an exemplary illustration of a brake assembly according to the present invention with force applied to the brake operating device engaging the brake.

FIG. 5 illustrates the example of the previous configuration, wherein the manual brake lever 3 is moved to the second direction 20. This causes the first brake wire 4 and the second brake wire 5 to move to the second direction 21, further causing engaging of the brake 1, 2. The brake 1, 2 comprises in this example a returning spring that pulls the brake pads to contact. This engaging action is secured by the pulling movement by the second brake wire 5 moving to the second direction 21. The second brake wire 5 helps the brake to engage with improved reliability.

The present invention increases the response time related to the manual brake lever 3. There is a reduced risk of jammed brake pads of faulty springs; the manual brake lever 3 may be used safely as there is the double action movement, and the manual brake lever 3 affects the brake 1, 2 directly when used in both directions.

Several of the embodiments may be combined together to form a further embodiment of the invention. It is to be understood that the exemplary embodiments are for exemplary purposes, as many variations of the specific hardware used to implement the exemplary embodiments are possible, as will be appreciated by those skilled in the hardware art(s). For example, the functionality of one or more of the components of the exemplary embodiments can be implemented via one or more hardware devices. While the present inventions have been described in connection with a number of exemplary embodiments and implementations, the present inventions are not so limited, but rather cover various modifications and equivalent arrangements, which fall within the purview of the prospective claims. The embodiments of the invention described hereinbefore in association with the figures presented and the summary of the invention may be used in any combination with each other. At least two of the embodiments may be combined together to form a further embodiment of the invention.

It is obvious to a person skilled in the art that with the advancement of technology, the basic idea of the invention may be implemented in various ways. The invention and its embodiments are thus not limited to the examples described above; instead they may vary within the scope of the claims.

The invention claimed is:

1. A brake assembly for an elevator, comprising:
a brake;
a brake operating device;
a first brake wire connected to the brake operating device and to the brake; and
a second brake wire separate from the first brake wire and connected to the brake operating device and to the brake,
wherein the brake operating device is configured to move the first brake wire and the second brake wire in opposite directions to activate or release the brakes.

2. The brake assembly according to claim 1, wherein the first brake wire is mechanically connected to the second brake wire.

3. The brake assembly according to claim 2, wherein the first brake wire and the second brake wire are joined together to form a single continuous wire.

4. The brake assembly according to claim 2, wherein the first brake wire and the second brake wire are connected to each other via a connecting wire.

5. The brake assembly according to claim 2, wherein the first brake wire moves in the same direction as the brake operating device.

6. The brake assembly according to claim 1, wherein the first brake wire and the second brake wire are joined together to form a single continuous wire.

7. The brake assembly according to claim 6, wherein the first brake wire and the second brake wire are connected to each other via a connecting wire.

8. The brake assembly according to claim 6, wherein the first brake wire moves in the same direction as the brake operating device is moved in the second direction.

9. The brake assembly according to claim 1, wherein the first brake wire and the second brake wire are connected to each other via a connecting wire.

10. The brake assembly according to claim 9, wherein the first brake wire moves in the same direction as the brake operating device is moved in the second direction.

11. The brake assembly according to claim 1, wherein the first brake wire moves in the same direction as the brake operating device.

12. The brake assembly according to claim 1, wherein the brake operating device is a lever.

13. The brake assembly according to claim 1, wherein the brake operating device is an actuator.

14. The brake assembly according to claim 1, wherein the brake is a machinery brake comprising at least two separate brakes.

15. The brake assembly according to claim 1, wherein the brake comprises a returning spring to engage the brake.

* * * * *